US009039322B2

(12) United States Patent
Francis et al.

(10) Patent No.: US 9,039,322 B2
(45) **Date of Patent: *May 26, 2015**

(54) PAVER HAVING DOWEL BAR INSERTER WITH AUTOMATED DOWEL BAR FEEDER

(71) Applicant: Guntert & Zimmerman Const. Div., Inc., Ripon, CA (US)

(72) Inventors: Richard W. Francis, Stockton, CA (US); Mark E. Storz, Modesto, CA (US); Daniel L. Blount, Modesto, CA (US)

(73) Assignee: Guntert & Zimmerman Const. Div., Inc., Ripon, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/759,972

(22) Filed: Feb. 5, 2013

(65) Prior Publication Data

US 2014/0023437 A1 Jan. 23, 2014

Related U.S. Application Data

(63) Continuation of application No. 12/556,486, filed on Sep. 9, 2009, now Pat. No. 8,382,396.

(51) Int. Cl.
*E01C 23/04* (2006.01)
*E01C 11/14* (2006.01)

(52) U.S. Cl.
CPC ..... *E01C 11/14* (2013.01); *E01C 23/04* (2013.01)

(58) Field of Classification Search
USPC ..... 404/88, 100
See application file for complete search history.

(56) References Cited

U.S. PATENT DOCUMENTS

| | | | | |
|---|---|---|---|---|
| 4,493,584 | A | 1/1985 | Guntert | |
| 6,176,643 | B1 | 1/2001 | Guntert, Jr. et al. | |
| 6,390,726 | B1 | 5/2002 | Guntert, Jr. et al. | |
| 6,390,727 | B1 | 5/2002 | Guntert, Jr. et al. | |
| 6,579,037 | B2 | 6/2003 | Guntert et al. | |
| 6,655,869 | B1 | 12/2003 | Deeb et al. | |
| 8,382,396 | B2 * | 2/2013 | Francis et al. | 404/88 |
| 2010/0086352 | A1 | 4/2010 | Guilbault et al. | |

OTHER PUBLICATIONS

Office Action issued on Apr. 12, 2012 in U.S. Appl. No. 12/556,486, filed Sep. 9, 2009, 5 pages.

* cited by examiner

*Primary Examiner* — Gary Hartmann
(74) *Attorney, Agent, or Firm* — Kilpatrick Townsend & Stockton LLP

(57) ABSTRACT

A paver for laying down a strip of concrete and inserting therein dowel bars parallel to the strip. A dowel bar inserter orients the bars and places them into the concrete. A pair of transport chains transverse to the travel direction extends across a width of the inserter. Pairs of generally L-shaped opposing cups hold the bars so that they can drop downwardly from the cups towards the strip. The chains move in a single direction. A dowel bar holding magazine, above the chains, stores bars, and gravitationally moves the bars towards the chains for pick-up by cups as the chains move the cups past a bar loading station. Elastic bands extend about a bar engaging surface defined by a wheel and resiliently bias the bars moving along the chain turn-around section against the wheel.

9 Claims, 11 Drawing Sheets

--PRIOR ART--

--PRIOR ART--

--PRIOR ART--

--PRIOR ART--

--PRIOR ART--

--PRIOR ART--

--PRIOR ART--

PAVER HAVING DOWEL BAR INSERTER WITH AUTOMATED DOWEL BAR FEEDER

CROSS-REFERENCES TO RELATED APPLICATIONS

This application is a continuation of U.S. patent application Ser. No. 12/556,486, filed Sep. 9, 2009, the disclosure of which is incorporated herein by reference.

BACKGROUND OF THE INVENTION

This invention relates to slipform pavers having dowel bar inserters with an automated dowel bar feeder that is configured to help increase the paving speed of the paver.

Well-known slipform pavers are typically used for laying down long strips of concrete as used, for example, on highways, airport runways and the like. The pavers are continuously supplied with fresh concrete as they travel in the direction of the strip, and they form the freshly supplied concrete into a rectangular, cross-sectional shape and properly finish the top surface of the strip after which the strip of concrete is allowed to set and harden. After the concrete has hardened, expansion joints are normally sawed across the width of the strip, and to maintain the integrity of the strip, dowel bars are inserted into the fresh concrete. The dowel bars are arranged parallel to the length of the strip and typically have diameters that range from about 1 inch to 2 inches and lengths from 12 to 24 inches.

Slipform pavers capable of inserting dowel bars as the strip of concrete is being laid down are well-known and are produced and widely distributed, for example, by the assignee of this patent application.

Dowel bar inserters place a line of dowel bars across the slab being formed and simultaneously insert from about 12 to 34 or more dowel bars depending upon the width of the strip being paved. Center-to-center spacing between the dowel bars typically varies between about 12 to 18 inches. As will be further described below, the mechanism that simultaneously inserts the dowel bars must remain stationary with respect to the strip of concrete being laid down while the dowel bars are inserted. The dowel bar inserter must therefore be able to move relative to the remainder of the paver during the dowel bar insertion.

Sets of dowel bars are regularly placed at intervals of typically about every 15 feet (4.57 M) in the direction of machine travel. Slipform pavers usually operate at speeds of up to 15 feet per minute, and more at times. In order to not impede the progress of the paver, the entire dowel bar insertion process must be completed in less time, at a speed of 15 feet per minute in less than one minute, or the speed of the paver must at least intermittently be reduced.

U.S. Pat. No. 6,579,037 (the "'037 patent") discloses a paver with a widely used dowel bar inserter, relevant portions of which are reproduced below to facilitate the reading and understanding of the present invention, and the '037 patent in its entirety is further incorporated herein by reference.

Prior art inserters of the type disclosed in the '037 patent required a manual loading of dowel bars into dowel bar holding cups, during which time the dowel bar inserter transport chains must be stopped. Such inserters reciprocably move the chains from a loading station for the dowel bars to their required insertion positions across the width of the concrete strip being laid down. This turned out to be a relatively slow process that frequently prevented paver operators from attaining the desired concrete laying machine speed of about 15 feet per minute, the machine speeds at times dropping to as low as 9 feet per minute or less.

This delay in timely completing the dowel insertion process affects the entire slipform paver because it slows down the concrete laying speed that can be attained. This is highly undesirable because it increases overall concrete laying costs.

BRIEF SUMMARY OF THE INVENTION

The present invention significantly increases the speed with which dowel bars can be placed into insertion positions across the strip of concrete being laid down so that the desired machine concrete laying speed of around 15 feet per minute can be maintained.

The need for manually placing the dowel bars into sets of receiving cups on reciprocating chains has been replaced by an arrangement that employs a magazine holding a supply of dowel bars that are to be inserted. A pair of dowel bar transporting chains that run in a single direction carry dowel bar engaging pairs of L-shaped cups (or lugs) and the dowel bars gravitationally drop from the magazine towards the cups at the loading station.

Due to the unidirectional movement of the dowel bar conveying chains, the high rate of dowel bar insertion from the magazine into the dowel bar holding cups, and the elimination of manually loading each dowel bar into the holding cups, a process during which the transport chains remain stationary, a paver provided with the dowel bar inserter of the present invention attains significantly higher dowel bar insertion rates, which in turn allows machine operators to run the pavers at the current optimal paving speed of about 15 feet per minute.

Thus, a paver for laying down a strip of concrete constructed in accordance with the present invention and capable of intermittently inserting into the strip sets of spaced-apart dowel bars that are oriented substantially parallel to the length of the strip generally has a tractor including a support structure and a propulsion system for moving the entire paver along the ground in the travel direction. A paving kit is operatively coupled to the tractor and shapes the strip of concrete. A dowel bar inserter connected with and trailing the paving kit orients the dowel bars substantially parallel to the travel direction and places the dowel bars into the concrete as it is being laid down.

The inserter has a pair of spaced-apart, endless chains that extend over a width of the inserter (in a direction transverse to the travel direction) and define upper and lower chain strands and chain turn-around sections at the ends of the strands. Shaft-mounted, chain-engaging sprockets are located at each turn-around section. A dowel bar holding magazine has a pair of spaced-apart dowel bar holding magazine plates that are positioned above and proximate to at least one of the turn-around sections for holding a multiplicity of dowel bars. The plates define parallel dowel bar release channels which, in a preferred embodiment, have a serpentine shape and from which dowel bars can gravitationally drop towards the chains. A depression beneath the release channels receives a dowel bar and holds it there during normal operational use of the paver. Pairs of associated, aligned dowel transporting cups or lugs extend away from exterior surfaces of the chains that face away from the chains, engage the dowel bar in the depression and transport it from the depression beneath the release channel over the width of the inserter.

A turn-around guide extends about the turn-around sections of the chains and includes an outer guide having an inwardly facing radially outer guide surface and an inner guide having a radially outwardly facing guide surface. The spacing between the guide surfaces is greater than the diameter of the dowel bars, and a resilient band generally extends about and is spaced apart from the outwardly facing guide surface of the inner guide. When dowel bars move along the turn-around guide, the resilient band biases the dowel bars against the inner guide surface. As a result, the dowel bars stay in the associated pairs of cups. A shuttle bar arrangement extends from a lower end of the turn-around guide over the width of the inserter and has spaced-apart slots into which the dowel bars gravitationally drop as the cups on the chains move them over the width of the inserter for subsequent insertion of the bars into the strip of concrete being laid down.

DETAILED DESCRIPTION OF THE INVENTION

Figure 1A:
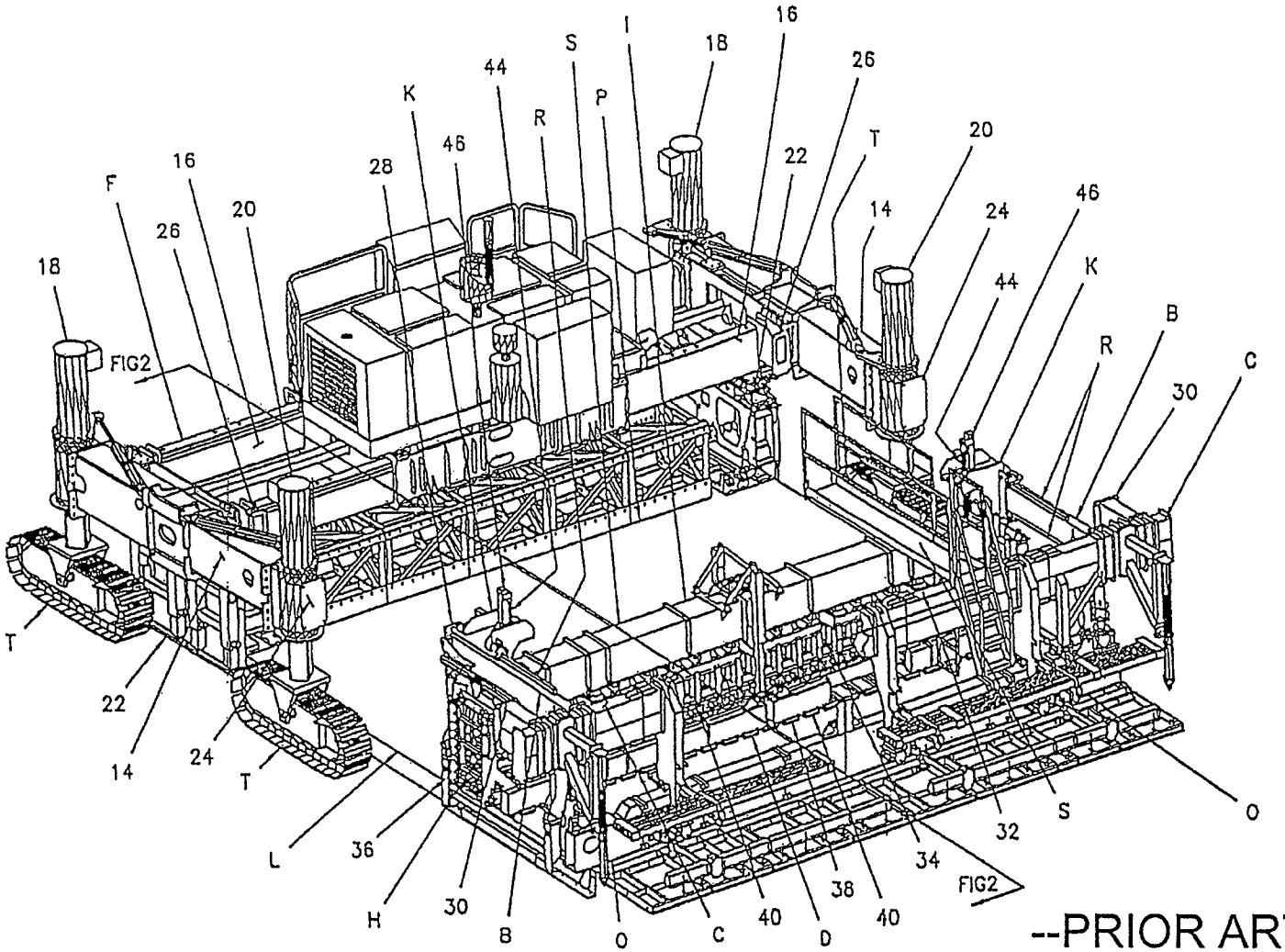
FIG. 1A is a perspective view of a slipform paver in accordance with U.S. Pat. No. 6,579,037 showing a slipform paver in exploded relationship with respect to a dowel bar inserter kit.

Initially copying substantial portions of U.S. Pat. No. 6,579,037, to facilitate the understanding of the environment and use of the present invention, and referring to FIG. 1A, a slipform paver P and a dowel bar inserter kit I are shown in exploded relationship.

Paver P includes paver bolsters 14, paver cross beams 16, front jacking columns 18 and rear jacking columns 20. Together, paver bolsters 14, paver cross beams 16, front jacking columns 18, and rear jacking columns 20 constitute paver frame F.

Paver P suspends slipform 22 from paver frame F. Finally, four crawler tracks T, for example, propel paver P in a forward direction X.

A dowel bar inserter kit I includes side bolsters B and at least one cross beam C. They form a rigid construction enabling the dowel bar inserter kit I to be handled in a unitary manner. Cross beam C has been broken away in the view of FIG. 1A to enable important working portions of dowel bar inserter kit I to be seen. Cross beam C is a unitary, rigid member which performs structural reinforcement function when dowel bar inserter kit I is attached to paver P and ties the dowel bar inserter kit I together when it is separated from paver P.

Front jacking columns 18 and rear jacking columns 20 level paver frame F with respect to a level reference system (not shown or discussed). Paver frame F is maintained level in a disposition for paving, and dowel bar inserter kit I must have that same level disposition in order to function properly. Accordingly, attachment of side bolsters B to paver frame F and rear jacking columns 20 will now be set forth.

Paver P requires the addition of four mounting flanges to enable side bolsters B to be attached to paver frame F. Rear jacking column flanges 24 and rear paver cross beam flanges 26 are provided on paver P. Similarly, front frame flange 28 and front jacking column flange 30 are provided on dowel bar inserter kit I. Thus, each side bolster B is rigidly affixed to paver frame F of paver P and maintains the same disposition of paver P when the required attachment occurs.

FIG. 1A does not show the required physical attachment; the exploded view is provided for convenience so that the kit may readily be distinguished from the paver. During attachment of dowel bar inserter kit I to paver P, hydraulic and electric power is most conveniently provided from paver P to dowel bar inserter kit I. Medially of paver P and medially of dowel bar inserter kit I there are respective electrical and hydraulic connections to provide the required power. These are conventional connections and are not shown.

Dowel bar inserter kit I at cross beam C and side bolsters B travels with paver P. Typical paving speeds can be as high as 15 feet (4.57 M) per minute. In the usual case, a set of side-by-side dowel bars are inserted into the concrete about every 15 feet. Thus, there is a need to rapidly deliver dowel bars to the dowel bar inserters and effect the placement of the dowel bars across the width of the recently placed slab.

It is instructive to understand both the geometry and operation of the dowel bar insertion.

Regarding the geometry of dowel bar inserters 32, such inserters are here shown mounted in arrays 34 of four inserters each. Each array 34 attaches to support beam S at and through a vibration isolator (not shown). Further, each array 34 of four inserters each includes three electrically, hydraulically or otherwise powered vibrators (also not shown).

Presuming that support beam S is stationary with respect to the just-formed slab L, insertion of the dowel bars can be described. Dowel bar inserter pan D is provided with continuous front member 36, raised rear member 38, and lane spacer members 40 therebetween. In between lane spacer members 40, there are dowel bar insertion apertures 42 (shown in FIG. 3B).

For explaining the geometry of the dowel bar inserters 32, the dowel bars are assumed to be lying on the freshly formed concrete slab L immediately under dowel bar inserters 32 array 34. All that is required is that support beam S be lowered and array 34 of dowel bar inserters 32 be vibrated. When this occurs, dowel bars are normally inserted to about the midpoint of freshly formed slab L. The placement of dowel bars into slab L is further addressed below with respect to FIGS. 3A, 3B and 3C.

Dowel bar insertion has an effect on the freshly slipformed slab L. Simply stated, both the added mass of the dowel bar and the vibration of dowel bar inserters 32 cause the surface of slab L to raise (or to be displaced) above that of the finished slab as it comes from slipform 22 on paver P. Thus, raised rear member 38 of dowel bar inserter pan D enables this raised (or displaced) portion of the concrete to freely pass out through the back of the dowel bar inserter pan D. As will hereafter be pointed out, dowel bar inserter kit I includes oscillating correcting beam O that causes the raised portion of slab L overlying each dowel bar to be refinished even with the remainder of the slab L. Further, dowel bar inserter kit I is supplied with its own sideforms. These sideforms confine the plastic concrete slab at the edges during dowel bar insertion. For convenience of transport, the sideforms hinge upward during transport.

Paver P and its attached dowel bar inserter kit I are continuously moving at a rate up to about 15 feet (4.57 M) per minute placing slipformed slab L. Thus, during the insertion, array 34 of dowel bar inserter forks 32 remains stationary with respect to the slipformed slab L. Rails R on side bolsters B and cars K supporting beam S at either end provide this function.

Side bolsters B are provided with rails R. Cars K ride on rails R toward and away from paver P. When cars K move away from paver P, cars K may be held stationary with respect to recently slipformed slab L even though paver P proceeds continuously in the forward direction at a relative speed of up to 15 feet (4.57 M) per minute. The "down cycle" of array 34 of dowel bar inserter forks 32 is in the order of 7 seconds. Further, dwell time at the full depth of insertion is about 3 seconds. Finally the "up cycle" of the array 34 of dowel bar inserter forks 32 is about 5 seconds. Thus a total excursion of cars K on crawler tracks T of side bolsters B in the order of 3.75 feet is required.

Figure 1B:
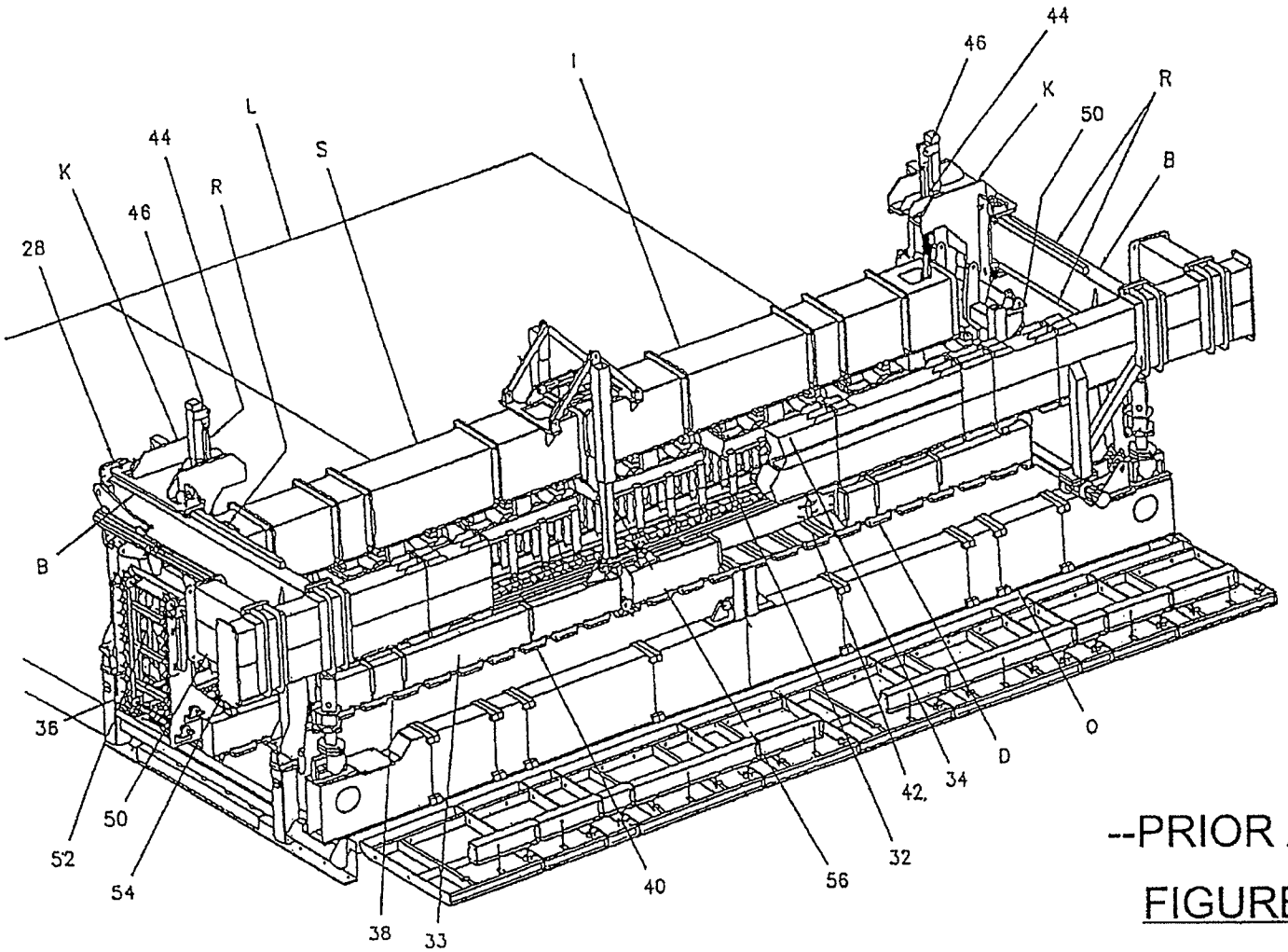
FIG. 1B is a partial perspective view of the dowel bar inserter kit showing the side bolsters, the bolster tracks, the dowel bar inserter supporting cars, the dowel bar inserters, the dowel bar inserter pan, the trailing oscillating screed, the trailing sideforms and supports and the finishing pan.
Figure 1C:
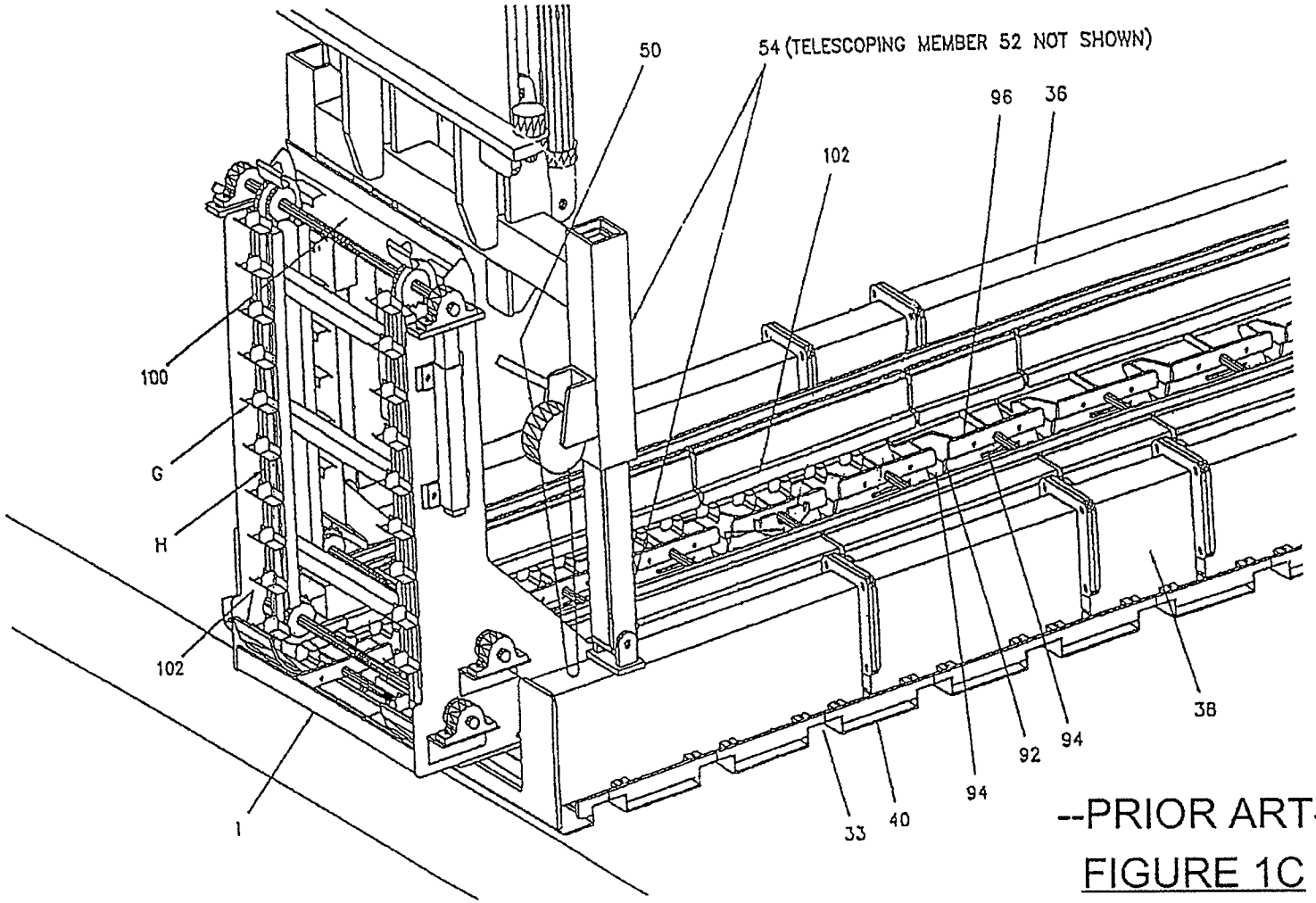
FIG. 1C is a partial perspective of the dowel bar inserter illustrating the deposit of the dowel bars into the upper dowel bar inserter, the dowel bars being readied for registration for insertion into the concrete slab.
Figure 2:
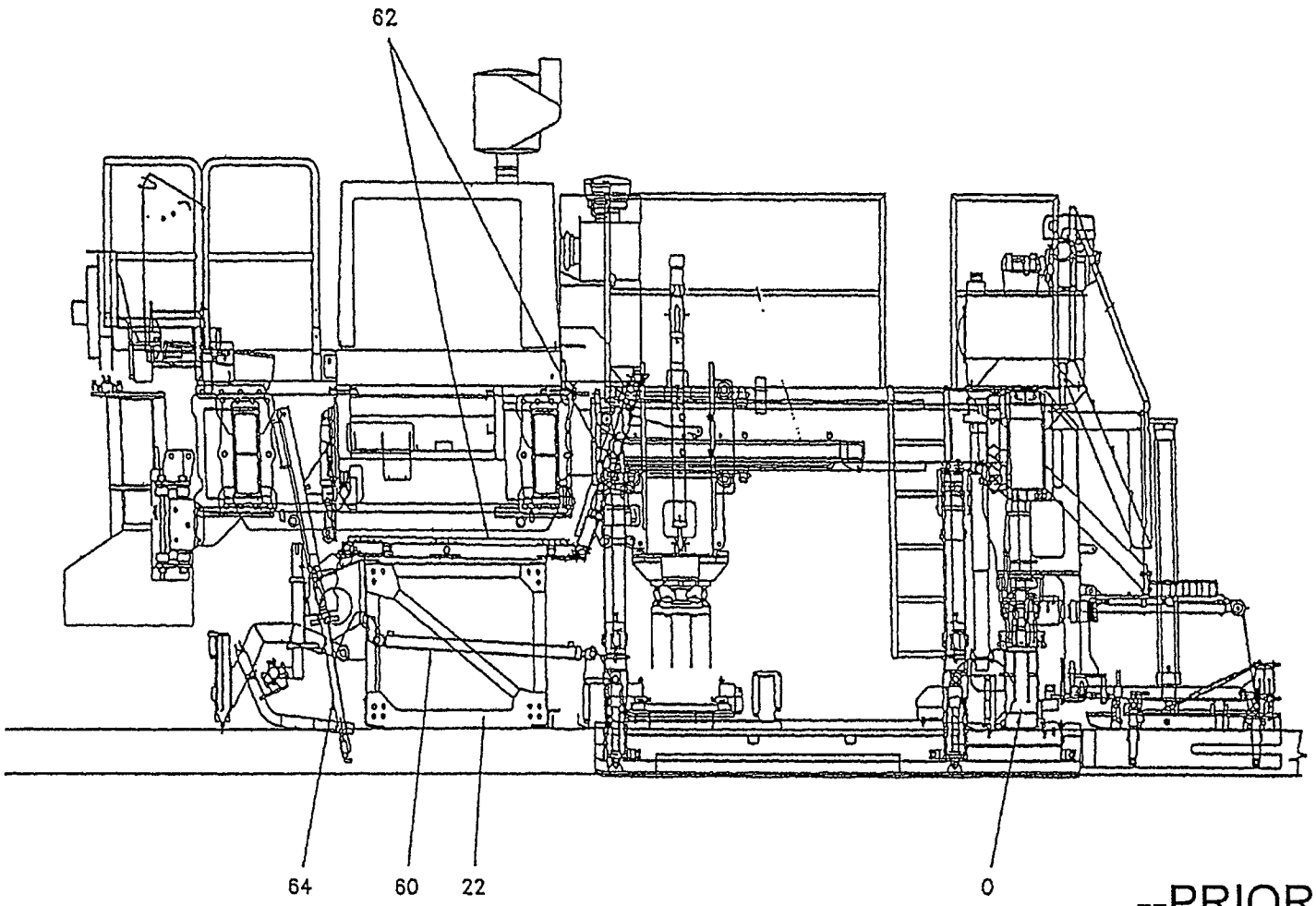
FIG. 2 is a cross-section taken along lines 2-2 of FIG. 1A illustrating the attached dowel bar inserter kit and paver.

Referring first to FIGS. 1B, 1C and 2, the suspension of dowel bar inserter pan D and the movement of support beam S are illustrated. FIGS. 1B and 1C show a dowel bar inserter pan D supported from cars K utilizing winches 50 and paired side telescoping members 52, 54 and central telescoping member 56. Support of dowel bar inserter pan D can easily be summarized. For the most part, dowel bar inserter pan D is supported by floating on freshly formed concrete slab L. Winches 50 adjust from cars K the total amount of weight of dowel bar inserter pan D on the concrete to prevent it from sinking or plowing and to allow it to be raised up out of the way, which is required when starting to pave. Further, and where super-elevation is encountered as in turns on modern roadways, weight distribution of dowel bar inserter pan D can be varied utilizing winches 50.

At the same time, it is necessary that dowel bar inserter pan D maintain its alignment with respect to support beam S. In this regard, paired side telescoping members 52, 54 and central telescoping member 56 maintain the required alignment with respect to cars K and support beam S.

During the insertion cycle, it is necessary that dowel bar inserter pan D remain stationary with respect to the freshly slipformed concrete slab L. Referring to FIG. 2, dowel bar inserter pan hydraulic cylinders 60 enable this controlled movement to occur. When it is desired to have dowel bar inserter pan D remain stationary with respect to slab L, dowel bar inserter pan hydraulic cylinders 60 are allowed to open freely against the weight of dowel bar inserter pan D resting on slab L. When dowel bar inserter forks 32 have been completely withdrawn (and have cleared the top of concrete) and it is desired to retrieve dowel bar inserter pan D, these cylinders are closed. In such closure, they cause the dowel bar inserter pan D to be gathered (retracted or recalled) to the paver P, while the dowel bars are left in place.

Next, the up and down movement of support beam S from cars K will be described. Each car K includes a hydraulic cylinder mounting clevis 46. A support beam S hydraulic cylinder 44 attaches at an upper end to hydraulic cylinder mounting clevis 46 and at a lower end to beam clevis 48 (shown in FIGS. 3A-C). With simultaneous expansion and contraction of support beam hydraulic cylinders 44, support beam S is lowered and raised from freshly slipformed slab L. When array 34 of dowel bar inserter forks 32 is maintained stationary with respect to slab L, dowel bar inserter forks 32 may insert and vibrate dowel bars into slab L.

Referring to FIG. 1C, an expanded view of dowel bar inserter pan D is shown. Three important elements are shown which are supported on dowel bar inserter pan D. First, at each dowel bar inserter fork 32 (best seen in FIGS. 3A-C), dowel bar inserter pan D defines a dowel bar pan aperture 33 which is bounded by continuous front member 36, lane spacer members 40, and raised rear member 38. Overlying each of these apertures there is placed lower shuttle bar 92 having lower shuttle bar slot 94. A dowel bar placed in lower shuttle bar slot 94 falls through dowel bar pan aperture 33 and onto the recently slipformed slab L. Lower shuttle bar slot 94 is of such a dimension that any dowel bar placed within the lower shuttle bar slot 94 will fall through to the slab. It is not required that lower shuttle bar slot 94 have the same dimension as the dowel bar being utilized. The lower shuttle bar slot 94 is sized to allow the maximum diameter dowel bar ever to be utilized on the dowel bar inserter kit to pass. The lower shuttle bar slot 94 simply acts as a guide for the dowel bar.

Fitted in sliding relationship on top of lower shuttle bar 92 is upper shuttle bar 96. Like lower shuttle bar 92 at lower shuttle bar slot 94, upper shuttle bar 96 defines upper shuttle bar slot 98. It is important to note that this upper shuttle bar height and its slot must have at least the same dimension as the diameter of the particular dowel bar being utilized. If the upper shuttle bar slot has a dimension exceeding that of the dowel bar by too large of a margin, possible jamming of dowel bar chain feeder H can occur relative to upper shuttle bar 96 and upper shuttle bar slot.

Figure 3A:
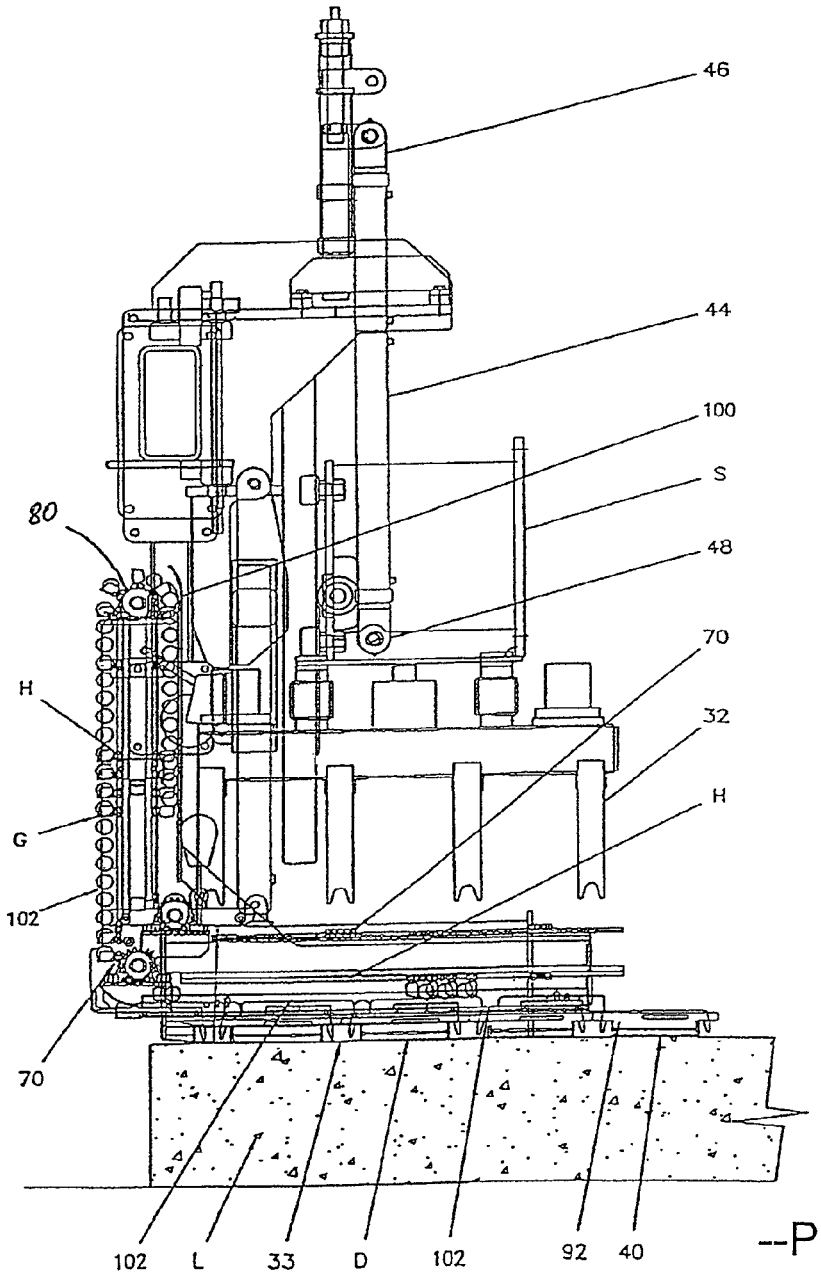
FIG. 3A is a side elevational view and illustrates the placement of the dowel bars into slots in the upper shuttle bars.

Referring to FIG. 3A, lower shuttle bar 92 at lower shuttle bar slot 94 is offset with respect to upper shuttle bar 96 at the upper shuttle bar slot. When the upper shuttle bar slot is empty of a dowel bar, the loading of such a dowel bar is best understood with respect to FIG. 3A.

FIG. 3A shows that an operator has loaded "L"-shaped lugs G with dowel bars. "L"-shaped lugs G are closely spaced. Further, dowel bar chain feeder H may be required to contain as many as fifty (50) dowel bars. This being the case, a magazine wall 100 is defined at the center of paver P. Excess bars travel over the top of sprockets 80 and are confined to dowel bar chain feeder H by magazine wall 100.

With dowel bar chain feeder H at "L"-shaped lugs G fully loaded with dowel bars, the endless loop of tie bar chain feeder H is rotated counterclockwise with respect to FIG. 3A. Dowel bars proceed along single-file dowel bar path 102. In passage along single-file dowel bar path 102, "L"-shaped lugs G push the respective dowel bars in their path parallel to the openings in upper shuttle bar slot within upper shuttle bar 96. Initially, upper shuttle bar 96 is offset with respect to lower shuttle bar 92 so that the respective upper shuttle bar slot does not align itself with respect to lower shuttle bar slot 94.

The first upper shuttle bar slot will be loaded with a dowel bar. The second and subsequent dowel bars approach the upper shuttle bar slot already loaded with a dowel bar and skip over the already filled upper shuttle bar slot. The dowel bars then proceed to the next empty upper shuttle bar slot, and so forth. Thus, the dowel bar chain feeder H serves to sequentially load all upper shuttle bar slots in all upper shuttle bars 96.

Figure 3B:
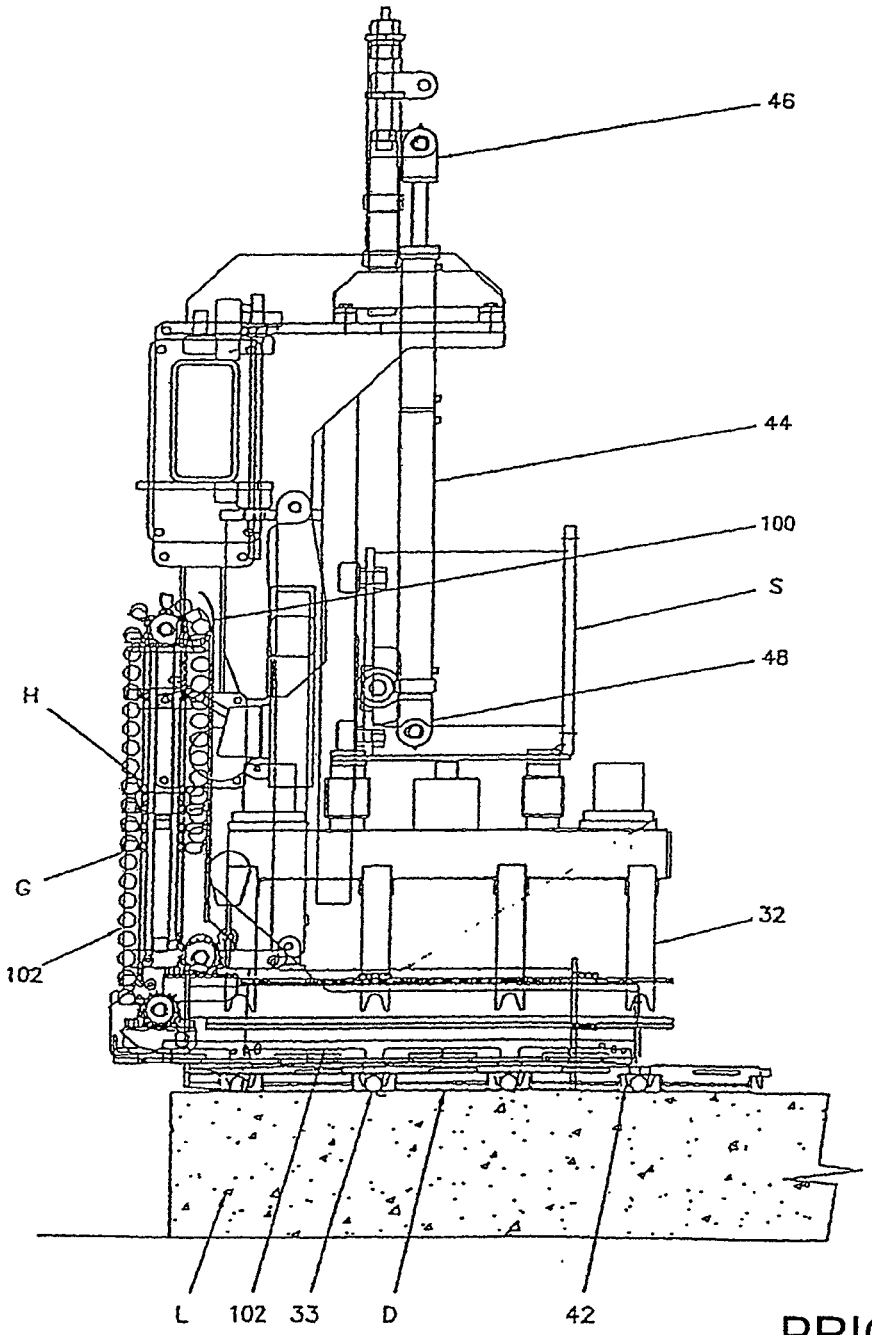
FIG. 3B is a side elevational view and illustrates the reciprocation of the upper shuttle bars relative to the lower shuttle bars with vertical movement of the inserters immediately overlying the placed dowel bars.
Figure 3C:
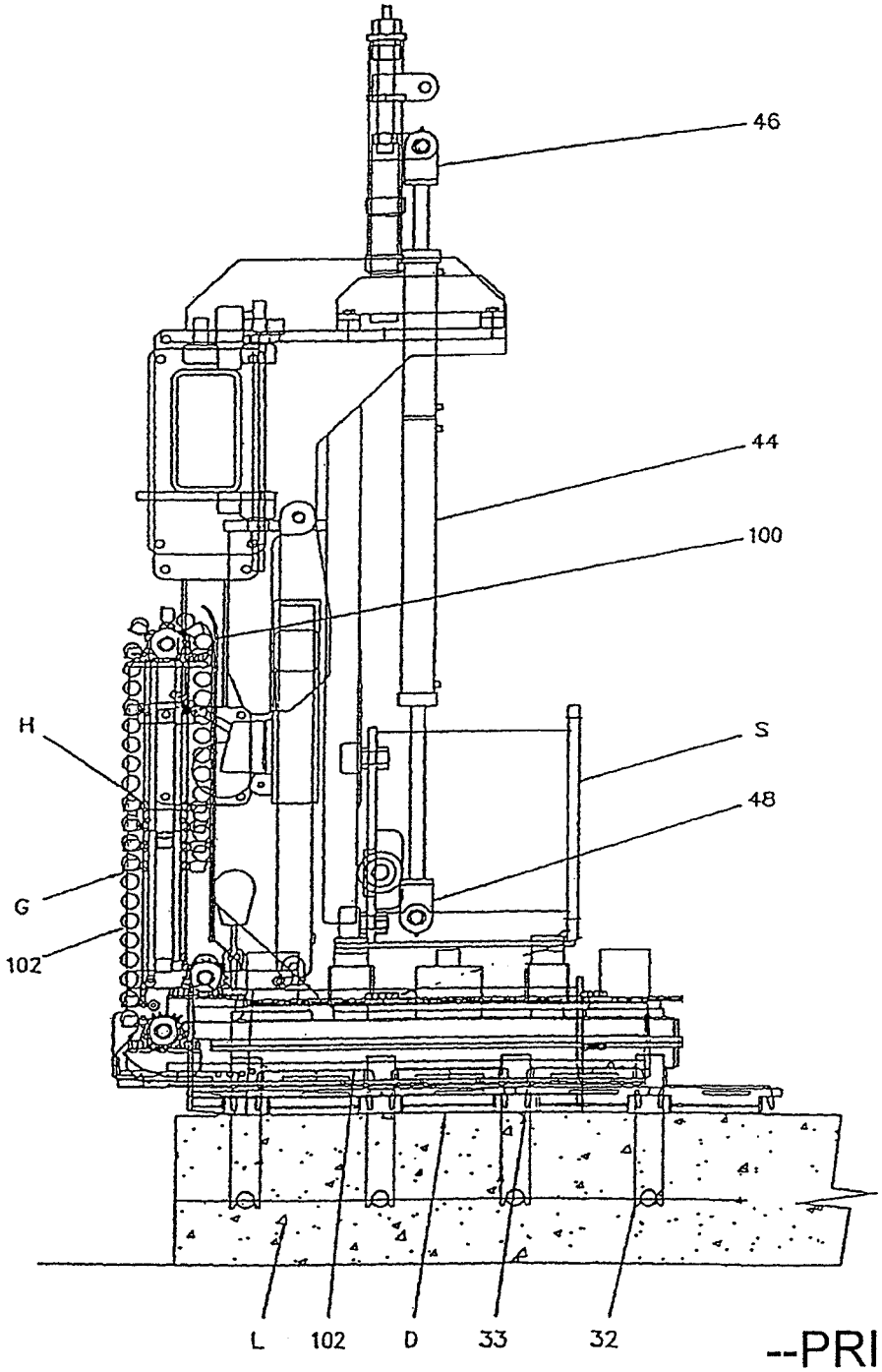
FIG. 3C is a side elevational view and illustrates the placement of the dowel bars to about the mid-point of a newly placed slipformed slab.

Referring to FIG. 3B, and when all upper shuttle bar slots are loaded with dowel bars, upper shuttle bar 96 reciprocates (by means of a hydraulic cylinder) relative to lower shuttle bar 92. This reciprocation occurs until registration occurs between the upper shuttle bar slot and the associated lower shuttle bar slot 94. When such registration occurs, all dowel bars fall onto concrete strip L being laid down. Thereafter the dowel bars are pushed downwardly into the strip of fresh concrete and the strip surface in the vicinity thereof is again smoothed as described in the '037 patent.

Figure 4:
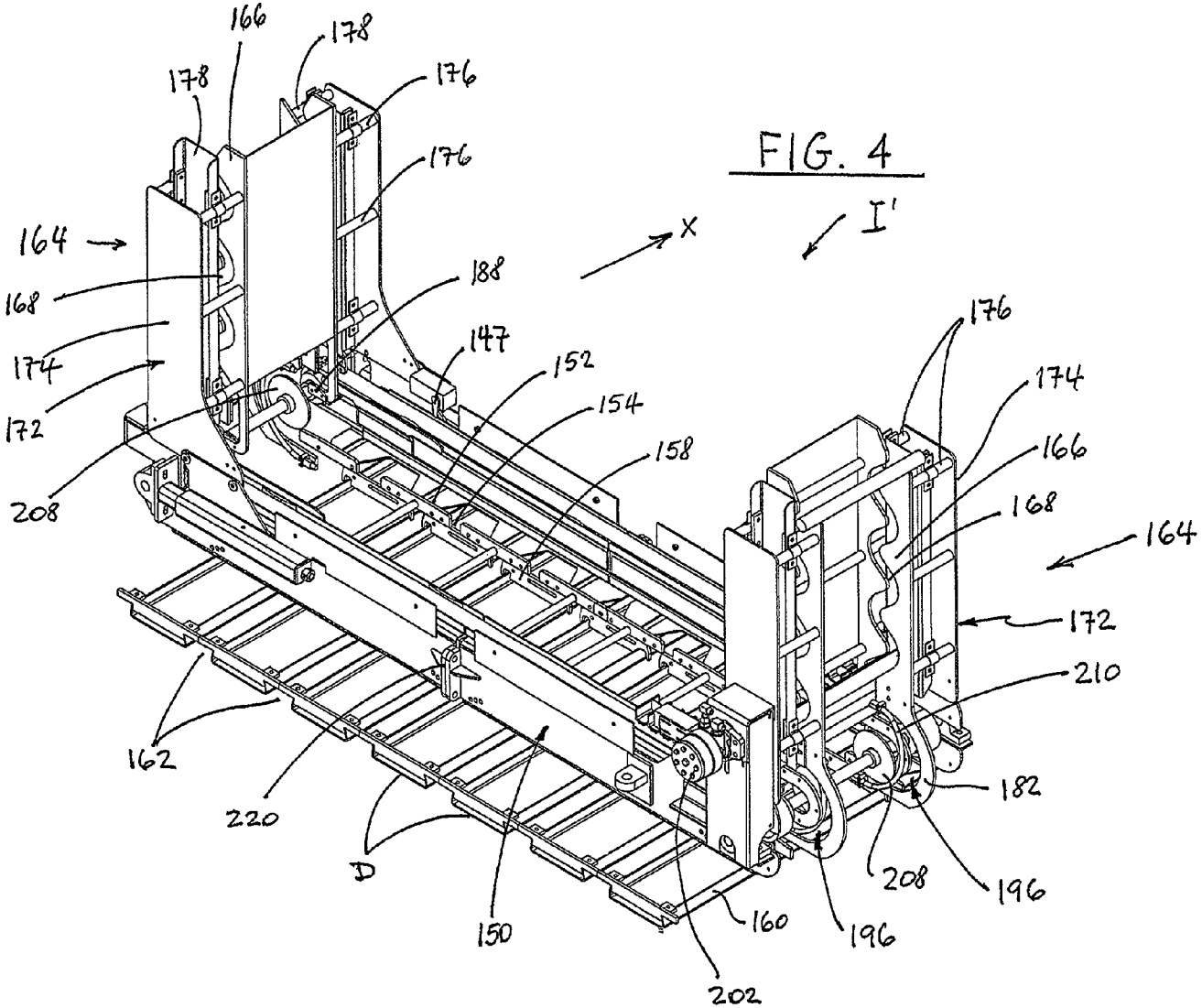
FIG. 4 is a side elevational, perspective view of the dowel bar inserter unit constructed in accordance with the present invention which is particularly adapted for use on pavers illustrated in FIGS. 1A-3C.
Figures 5, 6, 9:
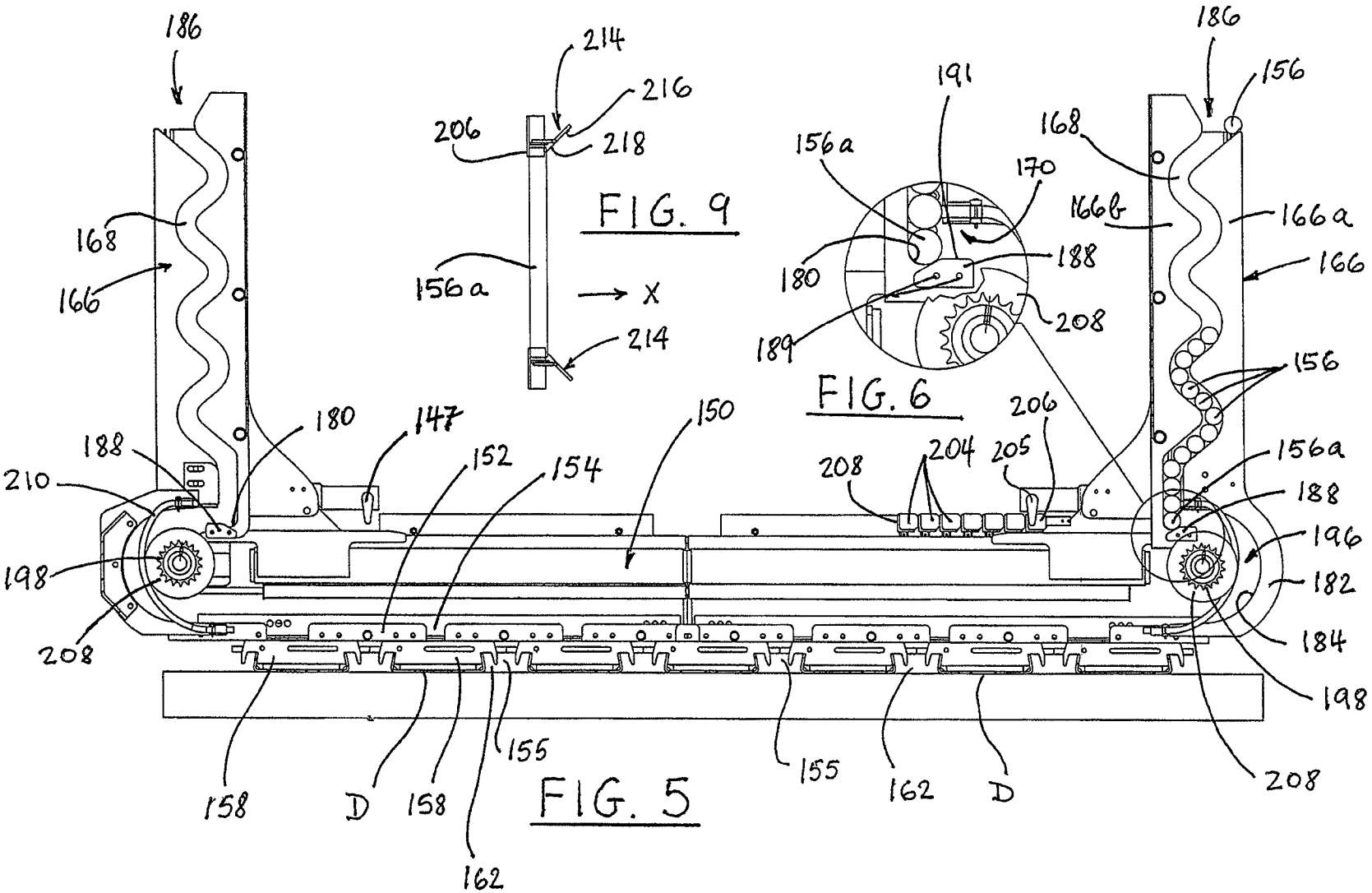
FIG. 5 is a front elevational view of the dowel bar inserter unit shown in FIG. 4.
FIG. 6 is an enlarged, fragmentary detail of the encircled portion of FIG. 5 and shows the transition at the dowel bar loading station from the dowel bar magazine to the dowel bar feed mechanism and how a dowel bar dropped from a magazine towards the chains below it is received in and retained in position during normal operating movement of the paver by a depression until a dowel bar is engaged and moved away by a dowel bar moving cup.
FIG. 9 is a plan view of dowel bar having clips which prevent dowel bars from rolling along the chain and permit dowel bars from gravitationally dropping out of the cups when the cups face downwardly towards the strip of concrete being laid down.

Referring now to FIGS. 4 and 5, inserter kit I' of the present invention is constructed so that it can be installed on and used with side bolsters B and cross beam C (not shown in FIGS. 4 and 5) described above. It has a frame (not separately numbered) which, in plan view, has a generally rectangular outline, and includes spaced-apart transverse supports 150 that are laterally spaced apart and upper shuttle bars 152 with intermittent upwardly open slots 154 into which dowel bars 156 drop, as is further described below. Beneath upper shuttle bars 152 are lower shuttle bars 158 which are suitably secured to upstanding walls 160 of dowel bar inserter pans D. Dowel bars are dropped through downwardly open slots 155 that extend into open spaces 162 between adjacent pans D. After the inserter kit has distributed the dowel bars into openings 154 in the upper bars, and the lower and upper bars have shifted relative to each other to align the upwardly open slots 154 with slots 155, the dowel bars drop into spaces 162 between inserter pans D for subsequent insertion of the dowel bars into the fresh concrete with dowel bar inserters 32 as was described above.

In use, inserter kit I is suitably attached to paver P (not shown in FIGS. 4 and 5), the dowel bar inserter pans D rest on the surface of the freshly formed concrete strip, and the inserter kit trails the paver and moves with the paver in the travel direction X over the length of the concrete strip being laid.

Referring to FIGS. 4-8, on at least one side a dowel bar holding magazine 164, instead of dowel bar holder H described in the '037 patent, is utilized and attached to one of the ends of transverse supports 150 for the inserter kit. The magazine is defined by a pair of spaced-apart magazine plates 166 formed by magazine plate front and aft sections 166*a*, 166*b*. The magazine plates define downwardly extending, aligned slots 168 that have lower, open ends (best seen in FIG. 6). Slots 168 are preferably serpentine-shaped because this lessens the total dowel bar load placed on the lowest dowel bar in the slots, and further because the serpentine slot shape permits storage of a relatively larger number of dowel bars over a given height of the slots.

The spacing between magazine plates 166 is less than the shortest dowel bar length that can be inserted with the inserter kit, and the slots have a width to accommodate the largest diameter dowel bar that is to be laid with the paver P. A frame 172 defined by upright plates 174 suitably connected with transverse supports 150 provides support for magazine 164. A plurality of horizontal spacer bars 176 rigidly connect magazine plates 166 and upright plates 174. Disposed between the adjacent magazine plates 166 and upright plates 174 are dowel bar end guides 178. Their position relative to the magazine plates can be adjusted to accommodate dowel bars of differing lengths while centering the dowel bars relative to the magazine plate.

The aft magazine plate 166*b* forms a curved end 180 at the lower open end 170 of the slot. The front magazine plate 166*a* extends further downward and curves outwardly to the right (as seen in FIG. 5) to form an arcuate arm 182 that defines an inwardly facing, curved guide surface 184 that constitutes a cage beyond which the dowel bars 156 cannot move.

In use, a multiplicity (that is, many) of dowel bars 156 can be stacked in the magazine by manually inserting dowel bars 156 through the upwardly open end 186 of serpentine slots 168. The dowel bars drop gravitationally downwardly, one on top of the other, beginning with a lowermost dowel bar 156*a* which rests on an abutment 188. The abutment is preferably constructed of an elastically deformable material, such as rubber, plastic, polyurethane and the like, and is suitably secured, e.g. with screws 189, against a side of each aft magazine plate 166*b*. A top surface 191 of the abutment rises slightly above curved end 180 of slot 168 so as to form a slight depression in conjunction with curved slot surface 180 in which the lowermost dowel bar rests. As a result, lowermost bar 156*a* cannot roll out of the depression during normal operations of the paver, such as, for example, when the paver travels along a banked curve, when forming concrete strips having a crowned surface and under similar conditions.

Referring now to FIGS. 4-8, a pair of endless chains 190 are laterally spaced (as seen in the direction of the chain lengths) from magazine plates 166 and define endless chain loops that have upper and lower strands 192, 194 and chain turn-around sections 196 between ends of the upper and lower strands which engage chain sprockets 198 that drive the chains in a single direction without any directional reversals during use of the paver. The sprockets are mounted on and driven by a shaft 200, and the shaft is suitably driven by motor 202, such as an electric or a hydraulic motor, for example, although other means for driving the shaft can be employed if desired.

A number of L-shaped, dowel bar receiving cups 204 are arranged on surfaces of the chains facing away from the chains. Each L-shaped cup is configured to receive therein a dowel bar 156, and they are mounted so that an open side of the cups faces in the travel direction of the chains (to the right as seen in FIG. 5) and an upstanding lug 206 of the bars, which serves to push the dowel bars in the cups with the moving chains.

In use, the requisite number of dowel bars to be placed across the strip of concrete is placed into the upwardly open slots 154 between upper shuttle bars 152 by activating motor 202 to move the chains in a forward direction via chain sprockets 198. The first L-shaped cup 206 begins movement to the right (as seen in FIG. 5), engages lowermost dowel bar 156*a* resting in the depression formed by abutment 188, and slightly lifts the dowel bar and/or deflects the abutment, particularly when it is constructed of a resilient material, and then moves the dowel bar into and through the chain turn-around section inboard of arcuate guide surface 184 defined by arm 182 of magazine plate 166*a*.

The continuing forward movement of the chains advances one L-shaped cup after the other past abutment 188 at the open end 170 of magazine slots 168 until a number of L-shaped cup pairs have been filled with dowel bars which corresponds to the number of dowel bars to be inserted across the width of the strip of concrete being laid.

Once the L-shaped cups 204 with the dowel bars between them reach lower strand 194 of the chains, the dowel bars drop gravitationally from the cups onto the upper surface of upper shuttle bars 152. As the chain advances, the dowel bars roll along the upper shuttle bar until the dowel bar in the first L-shaped cup 206 drops into the first upwardly open slot 154 between adjacent upper shuttle bar sections. The dowel bar substantially fills the slot so that the dowel bar in the following U-shaped cup pairs can pass over the filled slot and enter the next open slot. This process is repeated until the dowel bar in the last dowel bar cup drops into the last dowel bar receiving slot 154 in the upper shuttle bar. Thereafter, at suitable intervals, the upper and lower shuttle bars are reciprocated relative to each other to gravitationally drop the dowel bars from slots 154 via downwardly open slots 155 in the lower shuttle bar 154 and into openings 162 between adjacent dowel bar inserter pans D for subsequent insertion into the fresh concrete strip as earlier described.

Following placement of all dowel bars from the L-shaped cups 204 into slots 154 of the upper shuttle bars, the movement of the chains continues until the first L-shaped cup 206 is again proximate the downwardly open end 170 of magazine slots 168. A limit switch 205 is preferably provided for automatically stopping movement of the chains. Thereafter the entire dowel bar loading process as above described begins anew.

To decrease the amount of time required for loading the dowel bars, it is preferred to increase the speed of chains 190 following the placement of the last dowel bar into a slot in the upper shuttle bar 152. For this purpose, a limit switch 147 can be provided which is actuated, for example, by the first L-shaped cup 204 reaching this limit switch after the last dowel bar of the insertion cycle dowel bar has been inserted into the last upwardly open slot 154.

To assure a smooth transition of the dowel bars from the upper chain strand, where dowel bars are loaded into L-shaped cups 204, and the lower chain strand, from which the dowel bars are gravitationally dropped into dowel bar receiving slots 154, and to prevent inadvertent relative movements of the dowel bars, particularly as they move through the turn-around sections of the chain, dowel bar guide wheels 208 are mounted inboard of and in the vicinity of each magazine plate 166. Each wheel has a diameter so that its periphery is aligned with the surfaces of chain strands 192 which face away from the chains, that is, so that the periphery of the wheel is substantially tangent to these surfaces of the chains.

Figures 7, 8:
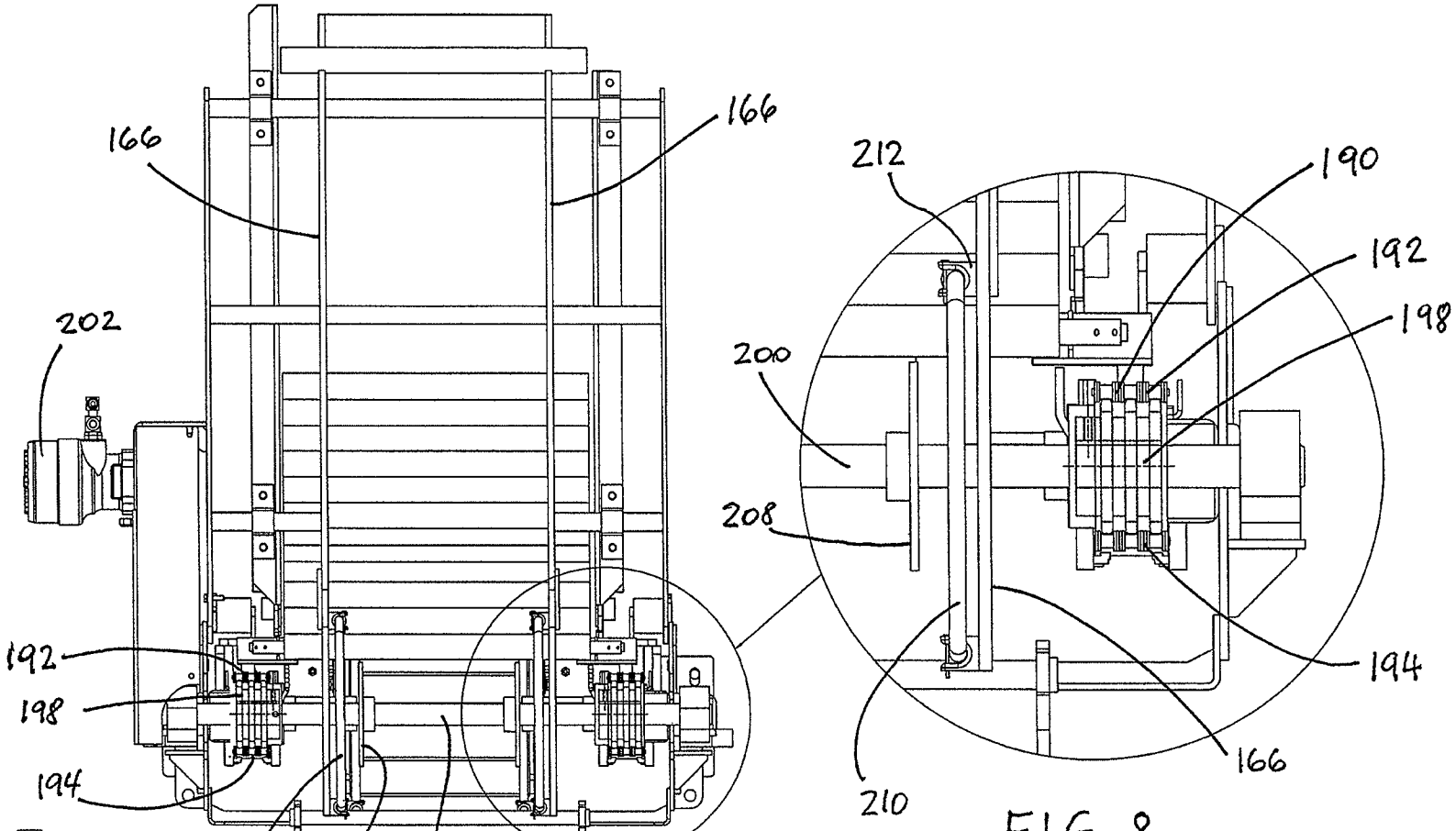
FIG. 7 is a side elevational view of the dowel bar inserter shown in FIG. 4.
FIG. 8 is an enlarged, partial view of the encircled portion of FIG. 7.

Further, the radial spacing between the peripheries of wheels 208 and the arcuate guide surface 184 defined by arm 182 is greater than the largest diameter of the dowel bars that will be laid with the paver. To maintain the dowel bars nested in the respective pairs of L-shaped cups 204 as the cups with the dowel bars in them travel through the chain turn-around section, a band 210 constructed of an elastic material, such as rubber, certain plastics and the like, resiliently biases the dowel bars into the associated cups. This prevents the dowel bars from unintentionally rolling out of the cups under the force of gravity, which, it if occurs, would require a shutdown of the entire paver until the dowel bars are properly repositioned, which is time-consuming, costly and therefore undesirable. As is best seen in FIGS. 5, 7 and 8, ends of the elastic band are fixedly secured to inner sides of the magazine plates 166, for example with appropriate clamps 212 or the like. As is shown in FIGS. 7 and 8, elastic bands 210 and guide wheels 208 can be offset with respect to each other, or they can be aligned (not shown).

Thus, in use, L-shaped cups 204, which are mounted closely adjacent to each other on the respective chains 190, pick up one dowel bar after the other and thereafter they travel through the turn-around section of the chain. While elastic bands 210 bias the dowel bars against the peripheries of guide wheels 208, the elastic bands are less well-suited for preventing a dowel bar from gravitationally slipping and/or rolling out of its pair of cups under the force of gravity in a direction perpendicular to lugs 208 during movement of the cups through the turn-around sections.

To prevent this from happening, and referring momentarily to FIG. 9, the first pair of L-shaped cups 206 which will engage the first dowel bar 156*a* are fitted with spring clips 214 that have forwardly (in the direction of chain travel) diverging arms 216 and a spring member, such as a leaf spring 218, which resiliently extends from the arm towards the dowel bar. This arrangement of the first L-shaped cups permits the first cup to engage the first dowel bar 156*a* nested in abutment 188. As the cups approach the first dowel bar, the dowel bar pushes the leaf springs 218 out of the way so that the dowel bar can enter the cups. Once in the cups, leaf spring 218 returns to its normal state (shown in FIG. 9) and prevents either end of the dowel bar from slidably or rollingly moving in a forward direction under gravity as the cups and the dowel bar in them move through the turn-around section of the chain. Once the first L-shaped cup 206 is directly above upper shuttle bar 152, the spring clips 214 will not prevent the dowel bar from gravitationally dropping out of the first pair of L-shaped cups, and lug 208 of the cup then continues to transport the dowel bar until it drops into the first dowel bar receiving slot 154.

Due to the close spacing of L-shaped cups 204 on chains 190, the dowel bars in all subsequent L-shaped cups remain closely adjacent to the upright lugs 208 of the L-shaped cup in front. As a result, dowel bar retaining clips 214 are not required on any of the subsequent cups.

In a preferred embodiment of the invention, an identical dowel bar magazine 164, including its interface with spaced-apart chains 190 and the construction of the turn-around section 196, is also provided at the other end of the chains. In all respects, this second magazine 164 and its operation are identical to the magazine as earlier described. The advantage of this arrangement is that dowel bars can be fed from either end of dowel bar insertion kit I'.

Figure 10:
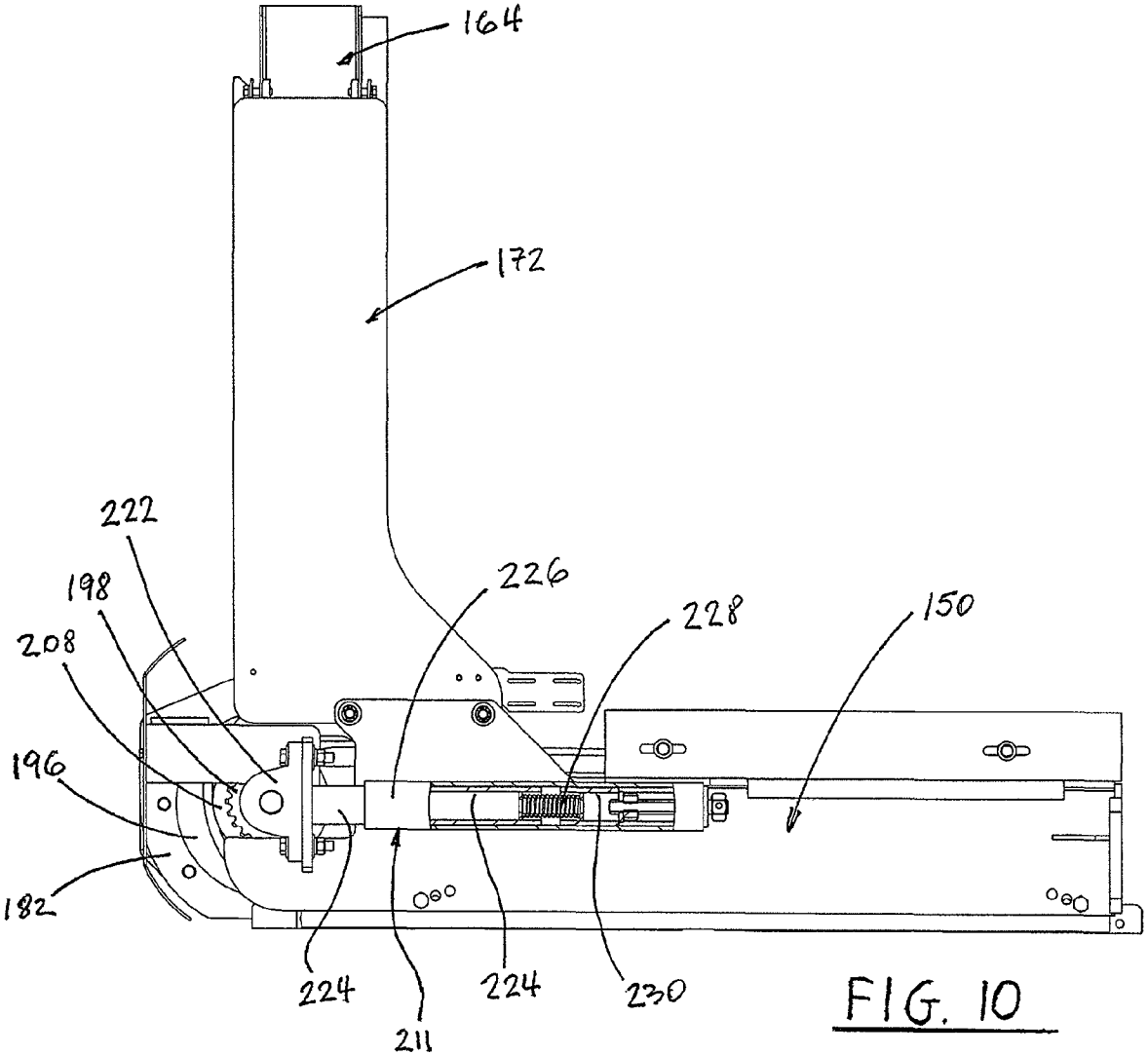
FIG. 10 is an enlarged detailed view showing an arrangement for keeping the dowel bar transporting chains taut when forming concrete strips with a crowned top surface.

Referring to FIGS. 4 and 10, at times the concrete strip being laid has a crown, meaning a mid-section that is relatively higher than its lateral sides. In such a case, the transverse support 150 for the dowel bar inserter is built in two sections, the opposing ends of which are suitably joined by a connector 220 which permits each section to be pivoted relative to the other so that the center portion of the support is relatively higher than its lateral ends. This slightly reduces the required overall length of the chains. A chain tensioner 211 prevents slack in the chains. Sprocket shaft 200 is mounted on bearings 222 which are secured to a tubular rod 224 of the chain tensioner disposed in a tubular housing 226 mounted to the transverse support 150. As is best seen in FIG. 10, a compression spring 228 is arranged between the end of the tubular rod inside the housing and an adjustable, screw-activated pressure tube 230. The compression spring generates a force tending to move the bearing away from the other end of the chain (not shown in FIG. 10) to thereby maintain the chains taut even when a crown strip is being laid down.

What is claimed is:

1. A paver for laying down a strip of concrete over a ground surface and for intermittently inserting into the strip spaced-apart dowel bars that are oriented substantially parallel to the length of the strip being laid down, the paver comprising:

a tractor including a support structure and a propulsion system for moving the paver along the ground in a travel direction, a dowel bar inserter unit for orienting the dowel bars substantially parallel to the travel direction of the tractor and placing the dowel bars into the concrete while the strip is being laid down, the inserter unit including:

a pair of spaced-apart, endless transport chains oriented transversely to the travel direction and substantially extending across a width of the inserter unit, each chain defining upper and lower strands, chain turn-around sections at respective ends of the chain strands, and an exterior chain side that faces away from the chain, a plurality of pairs of generally L-shaped cups, each pair of aligned cups being secured oppositely to each other on the respective exterior chain sides for holding a dowel bar so that the dowel bar can drop downwardly from the cups towards the concrete strip when the pair of cups holding the dowel bar are on the exterior chain side facing downwardly, a drive for moving the chains in a single direction, and a dowel bar holding magazine disposed above the upwardly facing sides of the chains, storing a multiplicity of dowel bars, and configured to drop a single dowel bar into empty pairs of cups as the chains move the cups past a dowel bar loading station defined by the magazine proximate one of the chain turn-around sections.

2. A paver according to claim 1 wherein the dowel bar holding magazine is defined by a pair of spaced-apart, substantially parallel magazine plates having aligned, downwardly extending, dowel bar holding slots having downwardly open ends located at the dowel bar loading station.

3. A paver according to claim 2 wherein the spacing between the spaced-apart magazine plates is less than a length of a shortest dowel bar to be inserted by the inserter.

4. A paver according to claim 2, including first and second limit plates spaced apart from respective sides of each magazine plate facing away from the other magazine plate for centering the dowel bars in the magazine relative to the magazine plates.

5. A paver according to claim 4 wherein the spacing between the magazine plates and the respective limit plates is adjustable.

6. A paver according to claim 1 wherein at least one of the pairs of L-shaped cups includes a retainer preventing the dowel bar disposed on the cups from moving relative to the cups in the direction of the chains and permitting the dowel bar to drop out of the pair of cups when the cups are on the exterior side of the chains facing in a downward direction.

7. A paver according to claim 6 wherein there are a multiplicity of pairs of cups for holding the dowel bars, and wherein the at least one pair of L-shaped cups is the first pair of the multiplicity of cup pairs facing in the moving direction of the chains.

8. A paver according to claim 1, including a limit switch for stopping movement of the chains when a first pair of L-shaped cups as seen in the movement direction of the chains arrives at the loading station following the placement of the dowel bars into the concrete.

9. A paver according to claim 1, including shafts mounting sprockets engaging the chains at the respective turn-around sections, and including a spring-biased effective chain length adjuster compensating for changes in the spacing between the shafts when the paver lays down a crowned strip of concrete.

* * * * *